United States Patent [19]

Fink

[11] Patent Number: 5,062,261

[45] Date of Patent: Nov. 5, 1991

[54] METHOD AND APPARATUS FOR TRANSPORTING A YARN PACKAGE TO A YARN PROCESSING MACHINE

[75] Inventor: Heinz Fink, Krefeld, Fed. Rep. of Germany

[73] Assignee: Palitex Project Company GmbH, Krefeld, Fed. Rep. of Germany

[21] Appl. No.: 467,169

[22] Filed: Jan. 18, 1990

[30] Foreign Application Priority Data

Jan. 21, 1989 [DE] Fed. Rep. of Germany ..... 3901770

[51] Int. Cl.[5] ..... D01H 9/18

[52] U.S. Cl. ..... 57/281; 57/350

[58] Field of Search ..... 57/281, 58.52, 58.7, 57/58.72, 58.83, 350

[56] References Cited

U.S. PATENT DOCUMENTS

| | | | |
|---|---|---|---|
| 3,599,413 | 8/1971 | Nimtz et al. | 57/281 X |
| 3,975,893 | 8/1976 | Franzen | 57/58.7 X |
| 4,120,142 | 10/1978 | Franzen | 57/58.83 X |
| 4,127,983 | 12/1978 | Munker | 57/58.7 X |
| 4,199,929 | 4/1980 | Vessella | 57/58.7 X |
| 4,236,374 | 12/1980 | Marbacher | 57/58.7 X |
| 4,354,343 | 10/1982 | D'Agnolo et al. | 57/58.7 X |
| 4,569,189 | 2/1986 | Frentzel-Beyme | 57/58.83 |
| 4,711,108 | 12/1987 | Frentzel-Beyme et al. | 57/58.83 X |
| 4,848,077 | 7/1989 | Kawarabashi et al. | 57/281 |
| 4,928,476 | 5/1990 | Otoshima et al. | 57/281 X |

FOREIGN PATENT DOCUMENTS

| | | | |
|---|---|---|---|
| 3545694 | 4/1987 | Fed. Rep. of Germany . | |
| 3545695 | 3/1988 | Fed. Rep. of Germany . | |
| 247273 | 10/1988 | Japan | 57/281 |

*Primary Examiner*—Joseph J. Hail, III

*Attorney, Agent, or Firm*—Bell, Seltzer, & Gibson

[57] ABSTRACT

A method and apparatus for transporting a wound hollow yarn package having a loose yarn end from a yarn processing machine and, preferably, between yarn processing machines, while maintaining the loose yarn end in defined and fixed positions. The yarn package is gripped in the yarn processing machine by inserting a hollow gripper device into one end of the hollow yarn package and the loose yarn end is pneumatically positioned in the hollow gripper device. The yarn package is removed from the yarn processing machine and placed on a hollow pin of a transporting mechanism by the gripper device and the loose yarn end is pneumatically removed from the gripper device and positioned in the hollow pin of the transporting mechanism. The gripper device is then removed and the yarn package is transported, preferably to a second yarn processing machine. At the second yarn processing machine, the yarn package is gripped by a further gripper device and the loose yarn end is pneumatically removed from the hollow pin of the transporting mechanism and inserted into the gripper device. The yarn package is then moved from the transporting mechanism and placed in desired position in a second yarn processing machine by the gripper device. The loose yarn end is then pneumatically moved from the gripper device and positioned in desired position in the second yarn processing machine and the gripper device is removed.

7 Claims, 5 Drawing Sheets

METHOD AND APPARATUS FOR TRANSPORTING A YARN PACKAGE TO A YARN PROCESSING MACHINE

FIELD OF THE INVENTION

The invention relates to a method and apparatus of transporting a yarn package between yarn processing machines, in particular a two-for-one twisting machine, wherein package gripper enter into the hollow core of a yarn package and locks in position therein, and wherein the yarn package held by the gripper is moved to and from yarn processing machines and a transporting mechanism a hollow pin of a transport system or of a yarn processing machine, whereupon the package gripper disengages again.

BACKGROUND OF THE INVENTION

In a modern spinning mill, it is often necessary to transport yarn packages from one yarn producing or yarn processing machine to another yarn processing machine. There are substantially two variants of transport systems which are used to this end, i.e., first, a package transport system, which rigidly links two production machines one directly with the other, such as, for example, a spinning machine with an automatic winding machine, and, second, a package transport system, which allows a flexible connection between production machines. In the latter case, the materials to be transported are transferred from a takeoff position on the first machine to a transport system, and from there, via a dispatch center, to a receiving point on the second machine.

In the case of the aforesaid two versions of transport systems, a great deal of attention must be paid to the arrangement and position of the yarn packages. This is necessary, on the one hand, for the further processing of the yarn packages on the next working position, and on the other hand, however, for safety reasons, since under circumstances dropping yarn ends considerably impede an automated transportation.

It is basically known to transport a yarn package by means of a package gripper, such as is disclosed, for example, in German Patent 35 45 694 or German 35 45 695.

OBJECTS AND SUMMARY OF THE INVENTION

It is an object of the present invention to create a method and apparatus for transporting a yarn package of the initially described kind, wherein the yarn ends assume a defined and fixed position in all stages of the transportation, so that, on the one hand, none of the yarn ends drop during the transportation, and that, on the other hand, a yarn end can be automatically grasped at the end of the transportation, thus permitting a proper feed of the yarn end for a further operation, such as, for example, an automatic feeding and starting. This means, the yarn is picked up, subsequently threaded through the new processing station and finally placed on a new takeup tube.

This object is accomplished in accordance with the present invention by providing a method and apparatus for transporting a wound hollow yarn package having a loose yarn end from a yarn processing machine and, preferably, between first and second yarn processing machines, while maintaining the loose yarn end in defined and fixed positions. In this method and apparatus, the yarn package is gripped in the yarn processing machine (first yarn processing machine) by inserting a hollow gripper device into one end of the hollow yarn package and pneumatically positioning the loose yarn end from the gripped yarn package in the hollow gripper device. The yarn package is then removed from the yarn processing machine (first yarn processing machine) and placed on a hollow pin of a transporting mechanism by the gripper device. The loose yarn end is then pneumatically removed from the gripper device and positioned in the hollow pin of the transporting mechanism. The gripper device is removed and the yarn package is transported by the transporting mechanism.

Preferably, the yarn package in the transporting mechanism is then gripped by a second hollow gripper device by inserting such gripper device into the hollow package and the loose yarn end of the yarn package is pneumatically removed from the hollow pin of the transporting device and positioned in the hollow gripper device. The yarn package is then removed from the transporting mechanism and placed in a second yarn processing machine by the gripper device. This could be the hollow spindle of a two-for-one twister machine. The loose end of the yarn package from the gripper device is pneumatically removed and positioned in desired position in the second yarn processing machine, which could include pneumatic threading through the hollow spindle of a two-for-one twisting machine. The gripper device is then removed.

Preferably, each gripper device includes a cylindrical first member for being inserted into the hollow yarn package and has expanding mechanisms extending from the outer circumference thereof for expanding into gripping engagement with the interior surface of the hollow yarn package, and a second member mounted rotatable with respect to the first member and having cam means thereon cooperating with the expanding means for causing expansion thereof upon rotation of the second member relative to the first member. Also, each of the gripper means preferably includes a hollow interior having incorporated therein an injector nozzle means for cooperating with the pneumatic means.

The basic concept of the method of the present invention is to see to it that, when a yarn package is transferred by means of a package gripper, for example, from a preparatory device to a transport system and from a transport system to a yarn processing machine, the yarn end or yarn ends of several superposed packages are each inserted by applying an underpressure and/or overpressure into the interior of the package gripper or respectively, upon its disengagement, into the interior of the hollow package core. As a result, the yarn ends assume during the entire transportation a defined position either before or inside the package core or inside the package gripper. Consequently, when the next transfer occurs, it is always possible to pick up the yarn end without difficulties and insert same in a defined position.

BRIEF DESCRIPTION OF THE DRAWINGS

The following will describe in greater detail an embodiment of the method of the present invention and an apparatus for carrying out this method with reference to the drawings, in which.

DETAILED DESCRIPTION OF PREFERRED EMBODIMENTS OF THE INVENTION

Figure 1:
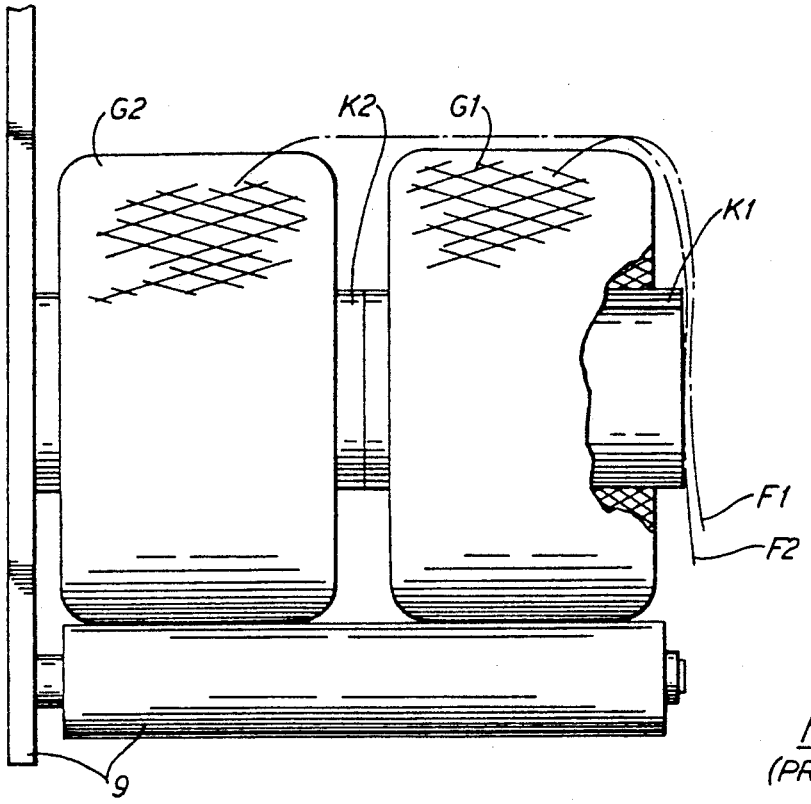
FIG. 1. (PRIOR ART)
FIG. 1 is a side view of two superposed yarn packages on a preparatory yarn processing machine.

FIG. 1 illustrates two superposed packages, on which a single yarn is respectively wound in a cross wind, and which form as a pair the feed yarn package of a two-for-one twisting machine. The yarn packages G1 and G2 rest with their circumference on a preparatory device known per se and indicated in its entirety by numeral 9, which serves to rotate the yarn packages and to simultaneously pick up the yarns ends F1 and F2, for example, with a suction nozzle not specially shown, and, as is shown in FIG. 1, to position same in the region before the hollow core K1 of the yarn package G1. If need be, the cores K1 and K2 of the two yarn packages G1 and G1 can be interconnected by a clips connection known per se.

Figure 2:
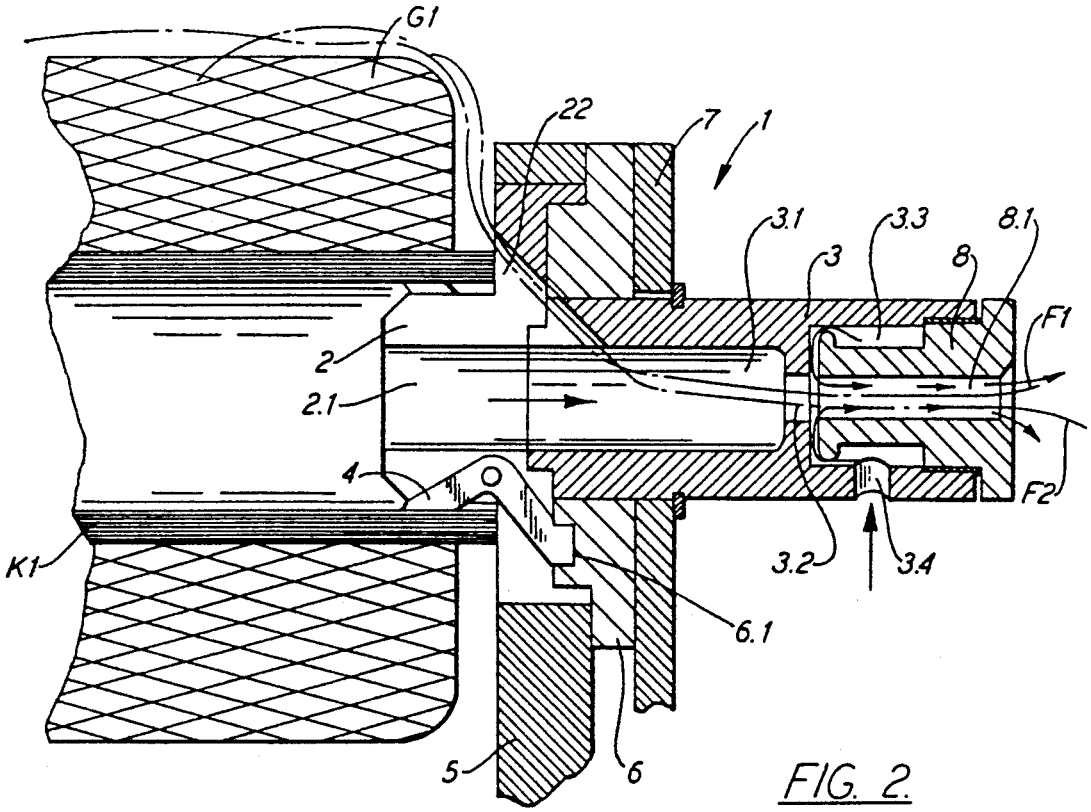
FIG. 2 is a longitudinal sectional view, slightly enlarged in comparison with FIG. 1, of the yarn packages of FIG. 1 after the engagement of a package gripper.

To remove the two yarn packages G1 and G2 from the preparatory device 9, a gripper 1 is used, as is shown in FIG. 2, which enters into the hollow package core K1 and locks in position therein.

The package gripper 1 possesses a basic body comprising two substantially cylindrical portions 2 and 3 rotatable relative to each other. The portions 2 and 3 have each a hollow, axial interior space 2.1 and 3.1 respectively. Arranged on the first portion 2, which faces in FIG. 2 the yarn package G1 and accommodates the inserting end, is an expanding means 4 in the form of a pivotal crosspiece. The inner end of the crosspiece 4 is guided in an eccentric groove 6.1 provided in a cam 6, which is rigidly connected with the second portion 3 and rests against a support plate 7. Also arranged on the first portion 2 is a manipulating element 5. The second portion 3 is constructed as a rotatable component. When rotating the portions 2 and 3 against each other, the crosspiece 4 is guided in the groove 6.1 so that it spreads outward and the portion 2, which is inserted into the package core K1, is held in position therein.

The interior space 3.1 of the second portion 3, which faces the inserting end is connected via a passage 3.2 with an interior space 3.3 arranged in the rear of the second portion 3. The interior space 3.3 accommodates an insert 8 in such a manner that an injector is formed in that a compressed-air stream entering through a lateral opening 3.4 flows into the axial bore 8.1 of the insert 8 and, in doing so, generates before the passage 3.2 an underpressure by the action of the injector. When the injector is actuated as the package gripper 1 enters into the core K1, the two yarn ends F1 and F2 are sucked in and guided through the axial interior spaces 2.1, 3.1 and passage 3.2 into the insert 8. To this end, the yarn ends F1 and F2 travel through a lateral slot 2.2 in the first portion 2 past the outer end of package core K1. Nonetheless, other ways of a pneumatic passage of yarn ends are conceivable.

Figure 3:
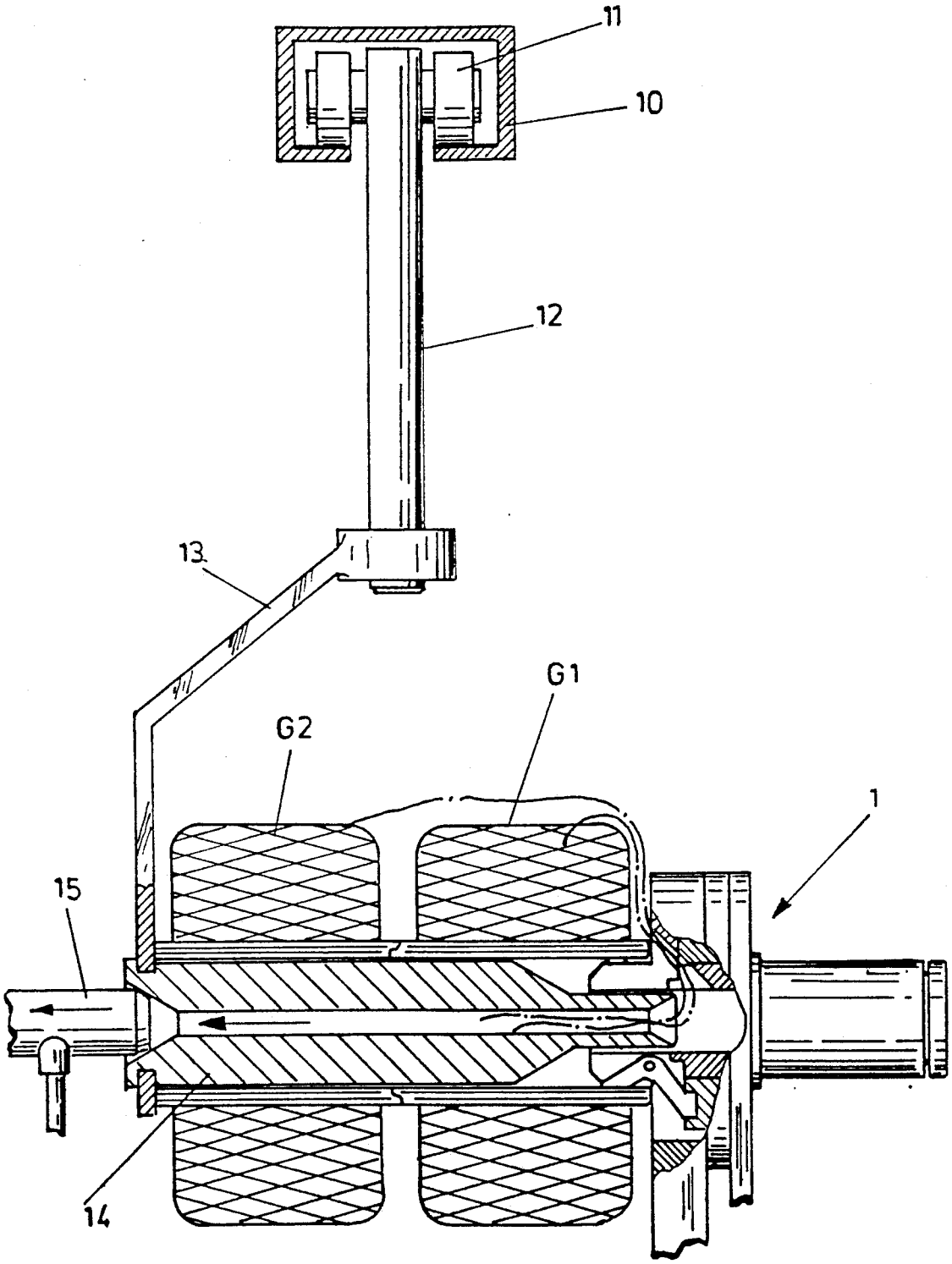
FIG. 3 is a partial sectional view of the two yarn packages of FIG. 1 after their transfer to a transport system.

The yarn packages G1 and G2 are removed in their state shown in FIG. 2 from the preparatory device 9 and moved to the transport system shown in FIG. 3. During this transfer, the yarn ends F1 and F2 are held in the package gripper 1 in a defined position.

The transport system shown in FIG. 3 is of a known type and comprises a rail 10, in which rolls 11 travel carrying a support arm 12. Attached to the latter is a carrying bracket 13, the lower end of which holds a hollow pin 14, on which the package cores K1 and K2 of the yarn packages G1 and G2 are placed in the manner shown in FIG. 3.

Before the package gripper 1 disengages from the yarn packages, it is necessary to remove the yarn ends F1 and F2 from the package gripper 1 and insert same into the hollow pin 14 of the transport system, so that they are again in a certain, defined position for their further transportation on the transport system.

This is accomplished in the illustrated embodiment in that the suction opening of an injector 15 is applied to the rear end of the hollow pin 14. As a result of a temporary actuation of this injector, the yarn ends F1 and F2 are sucked into the interior of the hollow pin 14. It is now possible to remove the package gripper 1, the injector of which was only temporarily actuated upon its engagement, and to convey the yarn packages G1 and G2 by the transport system.

Naturally, it is also possible to insert the yarn ends F1 and F2 into the hollow pin 14, in that the injector 15 is not applied to the hollow pin, but that the injector of the package gripper 1 is switched to "blowing" prior to its removal, so that the yarn ends F1 and F2 are blown into the hollow pin 14.

Figure 4:
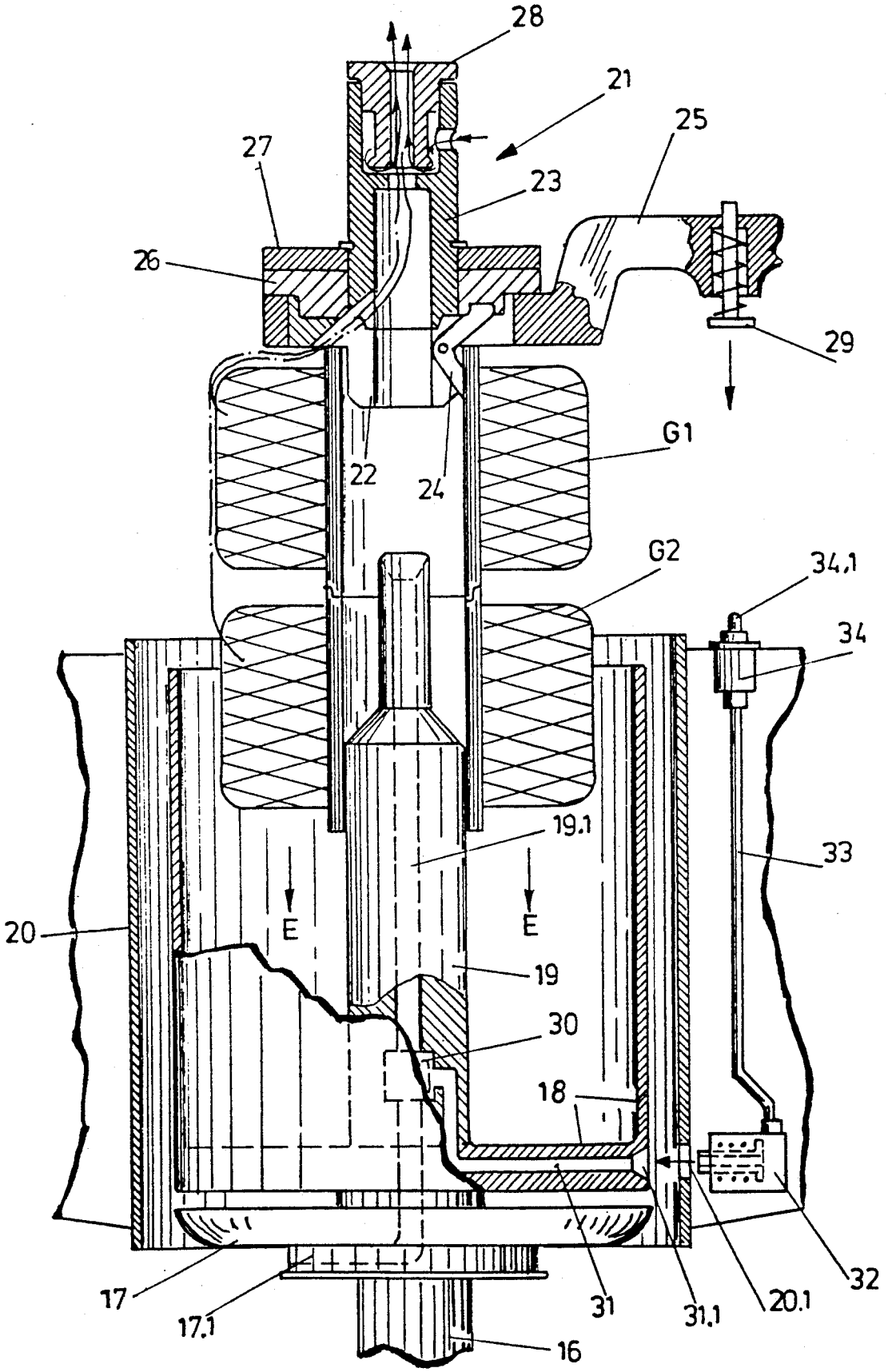
FIG. 4 is a sectional view, partially cut, of the two yarn packages of FIG. 1 as they are inserted into a two-for-one twisting spindle.

In both instances, the yarn ends are secured for their further transportation, and the two yarn packages G1 and G2 are moved by means of the transport system to a two-for-one twisting machine. At their arrival, as is shown in FIG. 4, they are removed by a package gripper 21 from the transport system. Basically, this gripper 21, as shown in FIG. 4, can be constructed in the same manner as the package gripper 1 illustrated in FIG. 2. It is provided at its lower end with an inserting portion 22 including an expanding means 24, and a cam 26, which rests against a support plate 27, and is rigidly connected with a second portion 23. The outer end of the second portion 23 accommodates an insert 28 for the purpose of forming an injector.

The package gripper 21 enters in a manner not specially shown into the core K1 of yarn package G1 on the transport system, and the removal of the yarn packages G1 and G2 from the transport system proceeds in the same manner as has been described hereinabove with reference to FIGS. 1 and 2. By the actuation of the injector arranged on package gripper 21, the yarn ends F1 and F2 are sucked out from the interior of the hollow pin 14 and sucked into the interior of the package gripper 21, so that they end up in being held therein in the position illustrated in FIG. 4. Shown in FIG. 4 is the creeling of the yarn packages G1 and G2 on a two-for-one twisting spindle.

In a known manner, a two-for-one twisting spindle comprises a whorl 16, a rotating platform 17 with a yarn storage disk 17.1 and a protective pot 18 with a hollow pin 19 axially arranged therein, on which the yarn packages G1 and G2 are creeled. Accommodated in the hollow pin 19 is an injector 30, the suction end of which connects to the interior space 19.1 of the hollow pin 19, and the air supply channel 31 of which extends through the protective pot 18 on its outer circumference, so that its air inlet opening 31.1 can be connected with a source of compressed air by means of a coupling device 32, which is adapted to pass through an opening 20.1 of the balloon limiter 20.

For the purpose of actuating the coupling device 32 and supplying compressed air through the channel 31, a control valve 34 is arranged in the region of the creeling end of the spindle outside the protective pot 18. This valve is connected via a line 33 with the coupling device 32 and links same with a source of compressed air when its switching element 34.1 is actuated in a manner not shown. As can be noted from FIG. 4, the switching element 34.1 is actuated by means of a spring-loaded actuator 29, which is arranged on a manipulating element 25 of the package gripper 21 and operative in direction of arrow B.

As can further be noted from FIG. 4, the pair of yarn packages G1 and G2 is creeled by means of the package gripper 21 on the hollow pin 19 of the two-for-one twisting spindle. Once creeling is completed, the injector 30 is actuated by the cooperation of actuator 29 with switching element 34.1, and the yarn ends F1 and F2 are sucked out of the interior of package gripper 21 and enter into the interior 19.1 of the hollow pin 19. Thereafter, the package gripper 21 can disengage from the yarn packages and be removed. Naturally, also in this instance, it is possible to insert the yarn ends F1 and F2 into the hollow space 19 by switching the injector arranged in the package gripper 21 to "blowing" rather than by actuating the threading mechanism comprising the injector 30.

Figure 4A:
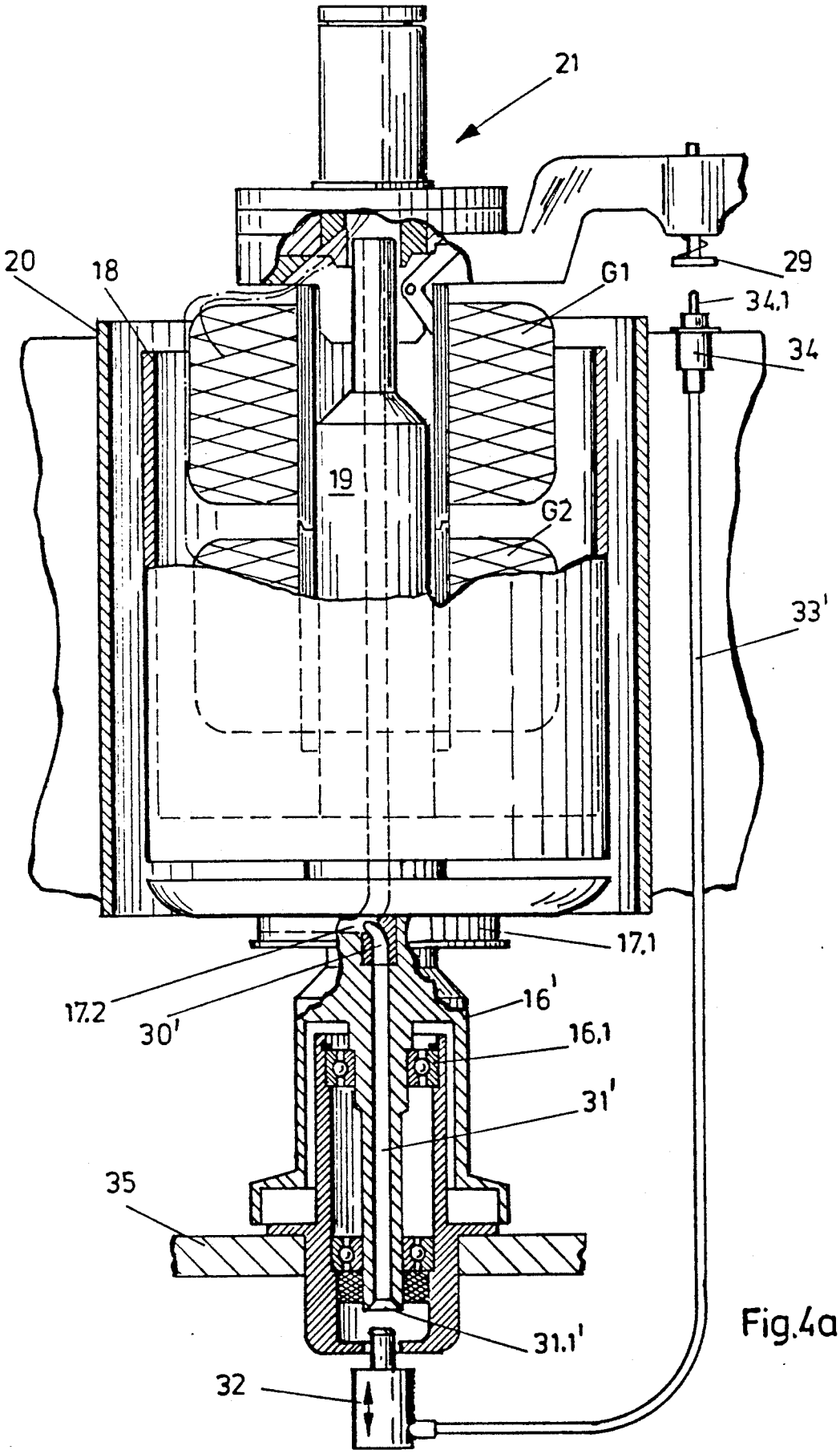
FIG. 4a is a view of FIG. 4 in a variant of a two-for-one twisting spindle.

As can be seen in FIG. 4*a*, it is also possible to supply the two yarn packages G1 and G2 to a two-for-one twisting spindle with a somewhat differently designed yarn threading mechanism than in the embodiment of FIG. 4. All parts of the two-for-one twisting spindle of FIG. 4*a*, which correspond to the illustration of FIG. 4, are indicated by the same reference numerals, and as to these parts reference should be made to the foregoing description. In the place of the injector 30 arranged in the hollow pin 19, the embodiment of FIG. 4*a* comprises a threading injector 30', which is arranged in the storage disk 17.1 at the intersection of the bore of hollow pin 19 and a radial channel 17.2. An air supply channel 31' extends downward through the whorl 16', which is supported in an antifriction bearing 16.1 on the machine frame 35, so that its air inlet opening 31.1' can be connected by means of a coupling device 32' and a compressed-air line 33' with the aforesaid control valve 34 and its switching element 34.1. The creeling of the yarn packages G1 and G2 on this two-for-one twisting spindle proceeds in the same manner as described with reference to FIG. 4.

Figure 5:
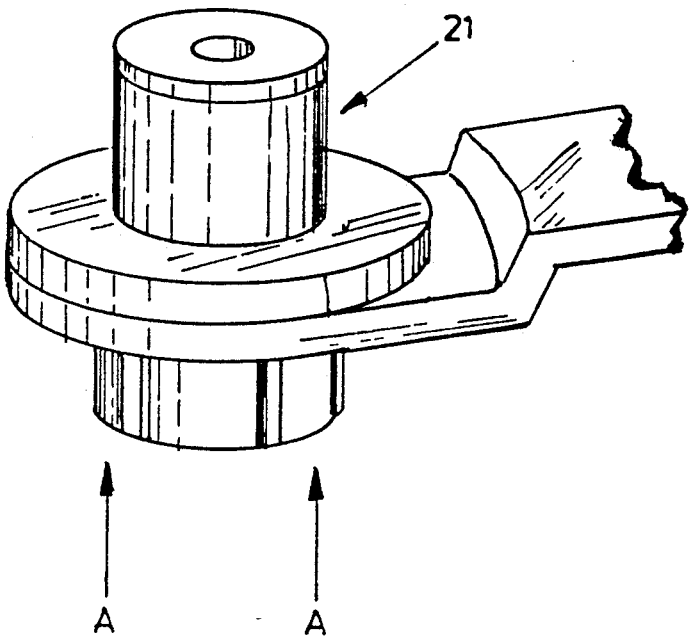
FIG. 5 is a perspective view, partially cut, of a two-for-one twisting spindle of FIG. 4 during the removal of a package gripper.
Figure 5:
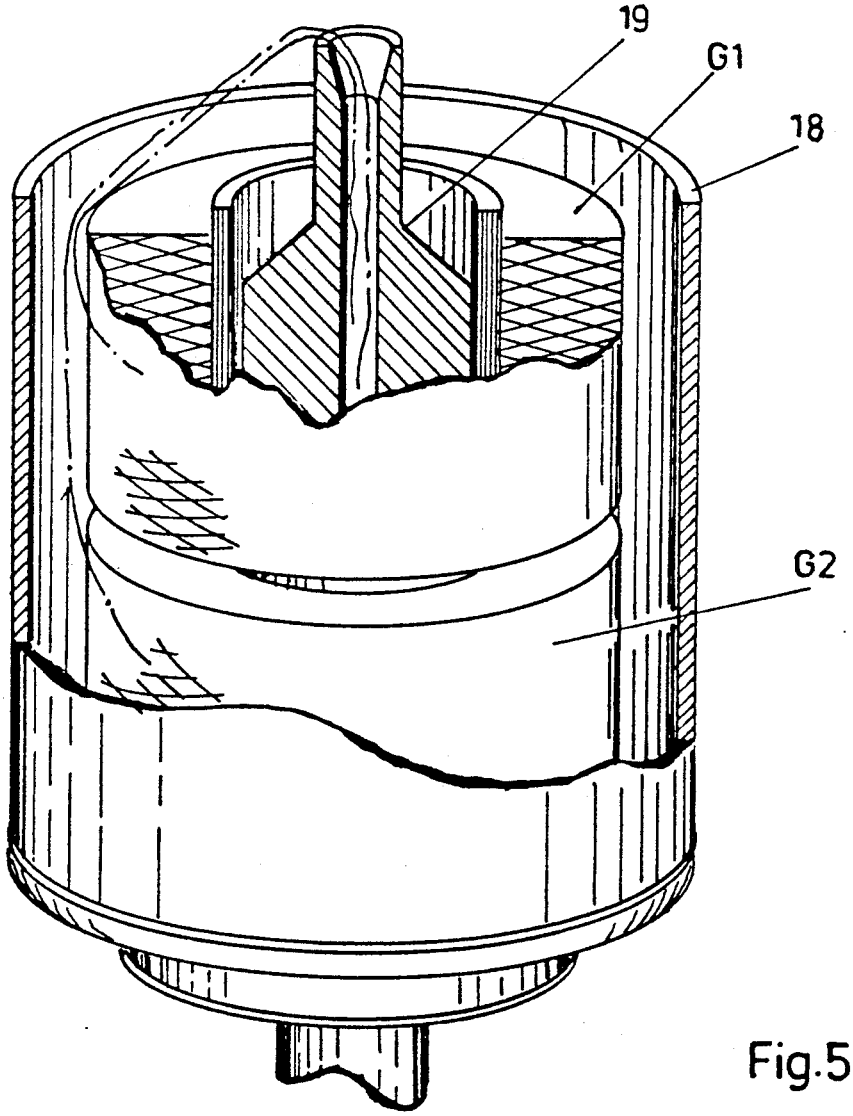

Shown in FIG. 5 are one more time the yarn packages G1 and G2 inserted into the two-for-one twisting spindle including the yarn ends F1 and F2 of the two packages as they are sucked into the upper region of the hollow pin 19. The package gripper 21 is removed in direction of arrows A.

The yarn is now fed to the two-for-one twisting spindle in a manner suitable for any further automatic procedure. Thus, for example, an automatic threading device can again suck in the yarn ends, unwind another sufficient yarn length and thread same along the usual path through a two-for-one twisting spindle by actuating a threading device integrated in the spindle and biased by compressed air.

Naturally, it is also possible to remove the yarn packages, without interposing a transport system, directly from a preparatory device and creel same on a two-for-one twisting spindle.

While with reference to the foregoing embodiments a method of transporting a yarn package to a two-for-one twisting machine has been described, wherein the yarn packages are cross-wound and inserted as two superposed packages into the two-for-one twisting spindle, it is naturally also possible to apply the same method to packages on which several yarns are wound in connection with assembly winding machines.

What is claimed is:

1. Method of transporting a wound hollow yarn package having a loose yarn end from a yarn processing machine while maintaining the loose yarn end in defined and fixed positions; said method comprising the steps of:

gripping the yarn package in the yarn processing machine by inserting a hollow gripper device into one end of the hollow yarn package;

pneumatically positioning the loose yarn end from the gripped yarn package in the hollow gripper device;

removing the yarn package from the yarn processing machine and placing the yarn package on a hollow pin of a transporting mechanism by the gripper device;

pneumatically removing the loose yarn end of the yarn package from the gripper device and positioning the yarn end in the hollow pin of the transporting mechanism;

removing the gripper device; and transporting the yarn package.

2. Method of transporting a wound hollow yarn package having a loose yarn end from a first yarn processing machine to a second yarn processing machine while maintaining the loose yarn end in defined and fixed positions; said method comprising the steps of:

gripping the yarn package in the first yarn processing machine by inserting a hollow gripper device into one end of the hollow yarn package;

pneumatically positioning the loose yarn end from the gripped yarn package in the hollow gripper device;

removing the yarn package from the first yarn processing machine and placing the yarn package on a hollow pin of a transporting mechanism by the gripper device;

pneumatically removing the loose yarn end of the yarn package from the gripper device and positioning the yarn end in the hollow pin of the transporting mechanism;

removing the gripper device;

transporting the yarn package to a second yarn processing machine by the transporting mechanism;

gripping the yarn package in the transporting mechanism by inserting a hollow gripper device into an end of the hollow yarn package;

pneumatically removing the loose yarn end of the yarn package from the hollow pin of the transporting device and positioning the yarn end in the hollow gripper device;

removing the yarn package from the transporting mechanism and placing the yarn package in a second yarn processing mechanism;

pneumatically removing the loose yarn end of the yarn package from the gripper device and positioning the yarn end in desired position in the second yarn processing machine; and removing the gripper device.

3. Apparatus for transporting a wound hollow yarn package having a loose yarn end from a yarn processing machine while maintaining the loose yarn end in defined and fixed positions; said apparatus comprising:

hollow gripper means for being inserted into one end of the hollow yarn package for gripping the yarn and for removing the yarn package from the yarn processing machine;

pneumatic means associated with said gripper means for positioning the loose yarn end from the gripped yarn package in said hollow gripper means;

transporting means including a hollow pin for receiving the yarn package from said gripper means and for transporting the yarn package after removal of said gripper means; and pneumatic means for removing the loose yarn end of the yarn package from said gripper means and positioning the yarn end in said hollow pin of said transporting means.

4. Apparatus, as set forth in claim 3, in which said gripper means includes a cylindrical first member for being inserted into the hollow yarn package and having expanding means extending from the outer circumference thereof for expanding into gripping engagement with the interior surface of the hollow yarn package, and a second member mounted rotatable with respect to said first member and having cam means thereon cooperating with said expanding means for causing expansion thereof upon rotation of said second member relative to said first member.

5. Apparatus, according to claim 3, in which said gripper means includes a hollow interior having incorporated therein an injector nozzle means for cooperating with said pneumatic means associated with said gripper means.

6. Apparatus for transporting a wound hollow yarn package having a loose yarn end from a first yarn processing machine to a second yarn processing machine while maintaining the loose yarn end in defined and fixed positions; said apparatus comprising:

first hollow gripper means associated with the first yarn processing machine for being inserted into one end of the hollow yarn package for gripping the yarn package and for removing the yarn package from the first yarn processing machine;

pneumatic means associated with said first gripper means for positioning the loose yarn end from the gripped yarn package in said first hollow gripper means;

transporting means including a hollow pin for receiving the yarn package from said first gripper means and for transporting the yarn package after removal of said first gripper means;

pneumatic means associated with said transporting means for removing the loose yarn end of the yarn package from said first gripper means and positioning the yarn end in said hollow pin of said transporting means;

second hollow gripper means associated with the second yarn processing machine for being inserted into one end of the hollow yarn package for gripping the yarn package and for removing the yarn package from said transporting means and placing said yarn package in the second yarn processing machine;

pneumatic means associated with said second gripper means for removing the loose yarn end from said hollow pin of said transporting means and placing the loose yarn end in said second gripper means; and pneumatic means associated with the second yarn processing machine for removing the loose yarn end of the yarn package from said second gripper means and positioning the yarn end in desired position in the second yarn processing machine.

7. Apparatus, as set forth in claim 6, in which each of said gripper means includes a cylindrical first member for being inserted into the hollow yarn package and having expanding means extending from the outer circumference thereof for expanding into gripping engagement with the interior surface of the hollow yarn package, and a second member mounted rotatable with respect to said first member and having cam means thereon cooperating with said expanding means for causing expansion thereof upon rotation of said second member relative to said first member.

* * * * *

UNITED STATES PATENT AND TRADEMARK OFFICE

CERTIFICATE OF CORRECTION

PATENT NO. : 5,062,261

DATED : November 5, 1991

INVENTOR(S) : Heinz Fink

It is certified that error appears in the above-identified patent and that said Letters Patent is hereby corrected as shown below:

ON THE COVER PAGE:

[56], Column 1, References Cited, "4,711,108" should be -- 4,711,081 --.

Column 1, line 10, "gripper" should be -- grippers --.

Column 1, line 14, "ing mechanism a hollow pin of a transparent system or of" should be -- ing mechanism. --. Delete remainder of line 14, and lines 15 and 16.

Column 6, line 68, "mechanism" should be -- machine --.

Signed and Sealed this

Fourth Day of May, 1993

*Attest:*

Michael K. Kirk

MICHAEL K. KIRK

*Attesting Officer*

*Acting Commissioner of Patents and Trademarks*